US007841023B2

(12) United States Patent
Winningham

(10) Patent No.: US 7,841,023 B2
(45) Date of Patent: Nov. 30, 2010

(54) SPORTS GLOVE HAVING FINGER KNUCKLE PROTECTION SYSTEM

(75) Inventor: Matthew M. Winningham, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 487 days.

(21) Appl. No.: 12/051,292

(22) Filed: Mar. 19, 2008

(65) Prior Publication Data

US 2008/0244799 A1 Oct. 9, 2008

Related U.S. Application Data

(60) Provisional application No. 60/895,502, filed on Mar. 19, 2007.

(51) Int. Cl.
*A41D 19/00* (2006.01)

(52) U.S. Cl. ..... 2/161.1; 2/163

(58) Field of Classification Search ..... 2/16, 2/20, 21, 161.1, 161.6, 163
See application file for complete search history.

(56) References Cited

U.S. PATENT DOCUMENTS

| | | | |
|---|---|---|---|
| 3,037,209 | A | 6/1962 | Applegate, Jr. et al. |
| 3,882,548 | A | 5/1975 | Shinagawa et al. |
| 4,094,014 | A | 6/1978 | Schroeder |
| 4,355,424 | A | 10/1982 | McCoy, Jr. |
| 4,411,024 | A | 10/1983 | Hayes |
| 4,497,073 | A | 2/1985 | Deutsch |
| 4,519,097 | A | 5/1985 | Chappell, Jr. et al. |
| 4,570,269 | A | 2/1986 | Berlese |
| 4,662,006 | A | 5/1987 | Ross, Jr. |
| 4,815,147 | A | 3/1989 | Gazzano et al. |
| 4,894,866 | A | 1/1990 | Walker |
| 4,894,868 | A | 1/1990 | Christopher |
| 4,930,162 | A | 6/1990 | Cote |
| 4,947,486 | A | 8/1990 | Hsuih |

(Continued)

FOREIGN PATENT DOCUMENTS

| | | |
|---|---|---|
| WO | WO03/013292 | 2/2003 |

(Continued)

OTHER PUBLICATIONS

Debeer, The Response, "Response" Glove, 2004.

(Continued)

*Primary Examiner*—Katherine Moran
(74) *Attorney, Agent, or Firm*—Warner Norcross & Judd LLP

(57) ABSTRACT

A protective sports glove having a protective finger knuckle system introduced to the back portion of the finger portions to cover the die cut regions of the pads corresponding to the knuckles of the fingers. The protective finger knuckle system includes a pair of cap portions each having a pair of side flanges that have a pair of slots, with the cap portions coupled together via a middle portion. A strap is feathered through the pair of slots on each of the pair of side flanges and beneath the cap portion and is secured to the glove. The middle portion span the gaps between the protective portions of the fingers and the thumb and thus provide protection to the knuckles of the wearer where the fingers or thumb are flexed.

20 Claims, 3 Drawing Sheets

U.S. PATENT DOCUMENTS

| | | | |
|---|---|---|---|
| 4,984,300 | A | 1/1991 | Cho |
| 5,329,639 | A | 7/1994 | Aoki |
| 5,345,609 | A | 9/1994 | Fabry et al. |
| 5,459,883 | A | 10/1995 | Garceau-Verbeck |
| 5,488,739 | A | 2/1996 | Cardinal |
| 5,511,243 | A | 4/1996 | Hall et al. |
| 5,548,844 | A | 8/1996 | Ceresia |
| 5,745,916 | A | 5/1998 | Linner |
| 5,787,506 | A | 8/1998 | Wilder et al. |
| 5,946,720 | A | 9/1999 | Sauriol |
| 5,974,588 | A | 11/1999 | Furman |
| 5,983,396 | A | 11/1999 | Morrow et al. |
| 6,085,354 | A | 7/2000 | Wilder et al. |
| 6,122,769 | A | 9/2000 | Wilder et al. |
| 6,154,882 | A | 12/2000 | Ullmann |
| 6,209,137 | B1 | 4/2001 | Wallick |
| 6,233,744 | B1 | 5/2001 | McDuff |
| D446,888 | S | 8/2001 | Morrow |
| 6,389,601 | B2 | 5/2002 | Kleinert |
| 6,405,380 | B1 | 6/2002 | Kuroda et al. |
| D462,146 | S | 8/2002 | Aoki |
| 6,453,474 | B2 | 9/2002 | Kleinert |
| 6,526,592 | B1 | 3/2003 | Best |
| 6,543,057 | B2 | 4/2003 | Beland et al. |
| 6,550,069 | B1 | 4/2003 | Morrow |
| 6,625,815 | B2 | 9/2003 | Litke |
| 6,681,402 | B1 | 1/2004 | Bevier et al. |
| 6,684,406 | B2 | 2/2004 | Fowler |
| 6,701,530 | B2 | 3/2004 | Kleinert |
| 6,813,780 | B2 | 11/2004 | Morrow |
| 6,959,453 | B2 | 11/2005 | Best |
| 7,000,256 | B2 | 2/2006 | Kleinert |
| 7,275,268 | B2 | 10/2007 | Gait |
| 7,370,373 | B2 | 5/2008 | Kohler |
| 2003/0014805 | A1 | 1/2003 | Morrow et al. |
| 2004/0010834 | A1 | 1/2004 | Sidlo |
| 2004/0060096 | A1 | 4/2004 | Thiruppathi |
| 2004/0093656 | A1 | 5/2004 | Morrow et al. |
| 2004/0123372 | A1 | 7/2004 | Kleinert |
| 2006/0107432 | A1 | 5/2006 | Cicero |
| 2007/0261149 | A1 | 11/2007 | Gait |
| 2008/0083048 | A1 | 4/2008 | Morrow et al. |
| 2008/0104737 | A1 | 5/2008 | Shepherd |
| 2008/0146981 | A1 | 6/2008 | Greenwald et al. |
| 2008/0178359 | A1 | 7/2008 | Grilliot et al. |
| 2008/0244799 | A1 * | 10/2008 | Winningham ..... 2/16 |
| 2009/0222967 | A1 * | 9/2009 | Winningham et al. ..... 2/21 |

FOREIGN PATENT DOCUMENTS

| | | |
|---|---|---|
| WO | WO2007/103985 | 9/2007 |

OTHER PUBLICATIONS

Debeer, The Tropic, "Tropic" Glove, 2004.
Debeer, The Arctic, "Arctic" Glove, 2004.
Brine, "Winter" Glove, 2004.
Brine, "Performance" Glove, 2004.
Brine "Elite" Glove, 2004.
Brine "Element" Glove, 2004.
STX "Reflex" Glove, 2004.
STX "Winter" Glove, 2004.
STX "3/4 Finger" Glove, 2004.

* cited by examiner

SPORTS GLOVE HAVING FINGER KNUCKLE PROTECTION SYSTEM

CROSS-REFERENCE TO RELATED APPLICATION

The present application claims priority from U.S. Provisional Patent Application Ser. No. 60/895,502, filed Mar. 19, 2007, and entitled "Sports Glove Having Protective Knuckle."

TECHNICAL FIELD

The present invention relates generally to a protective glove for use in contact sports, such as hockey or lacrosse. More particularly, the present invention relates to a protective sports glove having a finger knuckle protection system.

BACKGROUND OF THE INVENTION

In contact sports, such as lacrosse or hockey, where sticks are essential elements of the game, a player's hands, including their fingers and thumb, and wrists are especially vulnerable to injury when being checked by another player's stick. For this reason, players typically utilize padded gloves to protect their hands, wrists and lower forearms during play.

Typical gloves for such contact sports generally include a hand portion coupled to a plurality of finger portions and a thumb portion. The hand portion, the finger portions, and the thumb portion each have a respective palm portion and a protective back with a plurality of protective portions such as pads, disposed thereon to provide protection to a wearer's hand from forces applied thereto during play. The gloves also may have a protective cuff or portion that is coupled to a lower edge of the hand portion and extends downwardly from the back portion to protect the wearer's wrist and forearm. The protective back portions of the hand portion, the plurality of finger portions and the thumb portion are formed in such a way so as to allow them to flex during play in a manner corresponding to a wearer's hand, finger or thumb without significantly impacting the protection provided thereto.

One issue with gloves of this type is the degree of protection from impact provided to the wearer during usage. Foam padding or other protective structures on the outer portions of the gloves generally provide an adequate amount of relief from impact due to a stick, ball or puck. The amount of protection depends primarily upon the thickness and composition of the padding as well as the angle of impact of the device contacting the glove. In order to provide flexibility to the wearer's fingers, gloves are typically provided with flex or break lines between adjacent pads that are located over the respective knuckles of the fingers and thumb to accommodate increased movement of the wearer's fingers and thumb. Flex or break lines are also provided in the back of the hand for increased flexibility such that a glove is allowed to accommodate movement of a wearer's hand.

While these gloves have increased protection, it is known that to provide the desired flexibility, flex or break lines are provided in the glove. Thus, when a wearer flexes his fingers around the stick or otherwise flexes that hand, a gap is created between the adjacent pads in the area of the knuckles and exposes the knuckle making it particularly vulnerable to impact from a stick, ball or puck. Such impact can result in a serious injury to a wearer's fingers or thumb. Thus, there exists a need for a protective sports glove that provides protection to the knuckles or other exposed areas of a player's hand during usage, regardless of the amount of flex of the fingers or thumb, yet does not affect the degree of flex of the fingers or thumb during that same usage.

SUMMARY OF THE INVENTION

Accordingly, it is an advantage of the present invention to provide a protective sports glove that yields increased protection to the knuckles of the fingers of a wearer without adversely affecting the degree of flex or movement of the wearer's fingers during play.

It is another advantage of the present invention to provide a protective knuckle system for a sports glove that covers any gap or space created between adjacent protective portions when a glove is flexed by a wearer during play and protect any exposed area of a wearer's hand.

In accordance with the above and the other advantages of the present invention, a protective finger knuckle system for a protective sports glove is provided. The glove includes a protective knuckle system disposed on the outside or back portion of the glove generally in the finger portions to cover the seams in the regions of the pads corresponding to the knuckles of the fingers. The protective finger knuckle system is coupled to the glove and includes a pair of cap portions coupled together via a flexible middle portion, wherein the middle portion covers the seams or flex lines in the regions corresponding to the knuckles of the fingers. Each of the cap portions includes a pair of side flanges. The side flanges have a pair of slots. The cap portions are made of an impact resistant material, such as plastic or metal that protects a wearer's knuckle. A strap, preferably an elastic strap, is passed through the slots on each of the pair of side flanges to secure the cap portions to the glove.

The flexible middle portion spans the gap, corresponding to the seam or flex lines, between the adjacent protective portions of the fingers and/or the thumb. The middle portion allows flexing of the knuckles but maintains the cap portions in a position to provide protection to the knuckles of the wearer when the fingers or thumb are flexed. Because the protective knuckle portion is not coupled to the protective portions that move to create the gap, they are maintained in position over the widening gap as the finger is flexed. The knuckle protection system thus allows the finger to flex and unflex freely without restriction and without compromising protection as it covers the open space between adjacent protective portions and overlies the knuckle throughout the full range of wearer movement.

These and other features and advantages of the present invention will become apparent from the following description of the invention, when viewed in accordance with the accompanying drawings and appended claims.

DETAILED DESCRIPTION OF THE PREFERRED EMBODIMENT

Referring now to the Figures, which illustrate a protective sports glove 10 in accordance with the present invention. While the drawings illustrate the right hand glove, it will be understood that the left hand glove has the same configuration, but opposite orientation and thus need not be described separately. The disclosed glove 10 is preferably for use in the game of hockey. However, it will be understood by one of ordinary skill in the art that the disclosed glove 10 may be used in a variety of other contact stick sports, including lacrosse. Additionally, the protective sports glove may have a variety of other suitable uses.

Figure 1:
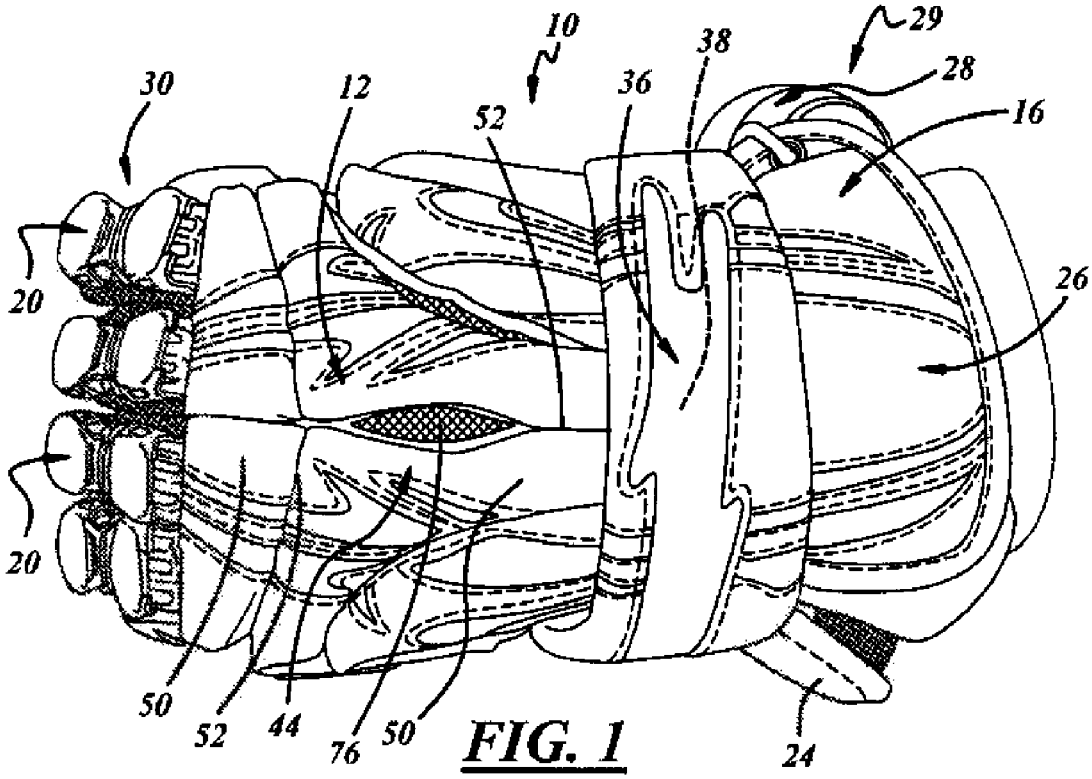
FIG. 1 is a top backside view of a protective sports glove with a protective knuckle system in an unflexed position in accordance with a preferred embodiment of the present invention.
Figure 2:
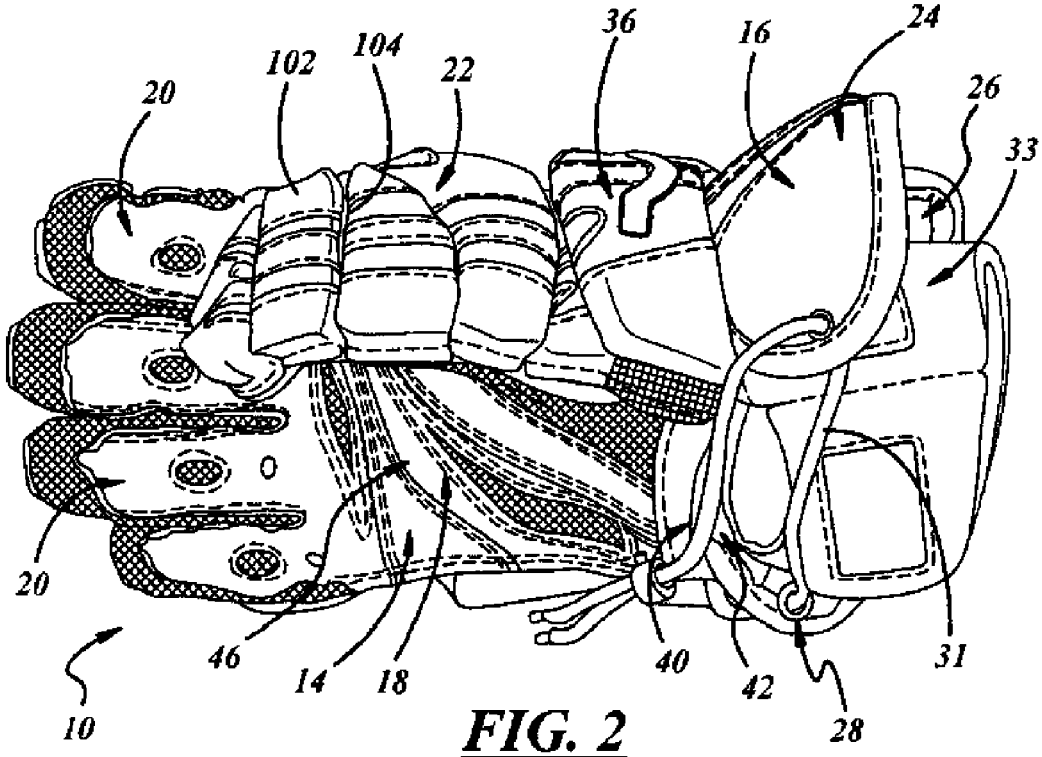
FIG. 2 is a bottom palmside view of the protective sports glove of FIG. 1.
Figure 3:
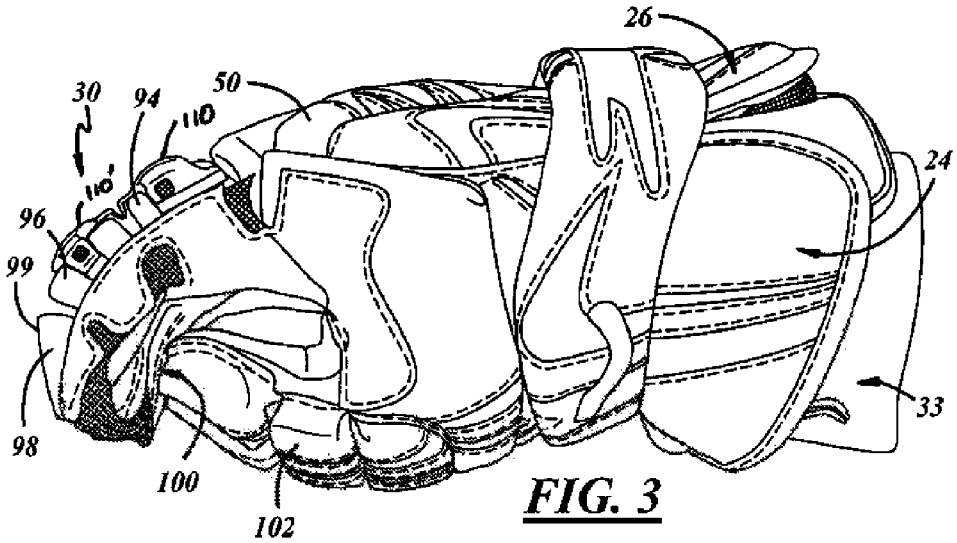
FIG. 3 is a side view of the thumb side of the protective sports glove of FIG. 1.

Referring now to FIGS. 1 through 3, the glove 10 has a top or back side portion 12 and a bottom or palm side portion 14 which therebetween define an interior space for receipt of a wearer's hand. The glove 10 generally has a cuff portion 16, a hand portion 18 coupled to the cuff portion 16, a plurality of finger portions 20 extending from the hand portion 18, and a thumb portion 22 also extending from the hand portion 18. Coupled beneath the cuff portion 16 is a floating subcuff portion 33. In one embodiment, the cuff portion 16 can include a floating subcuff portion 33 disposed within and coupled to the cuff portion 16. One or more of the finger portions 20 includes at least one protective finger knuckle system 30, as discussed in more detail below in connection with FIGS. 4A-C, 5 and 6.

The cuff portion 16 preferably has a first cuff portion 24, an adjacent second cuff portion 26, and an adjacent third cuff portion 28 that are each secured at an upper border portion located near the hand portion 18. Preferably, the edge portions of the cuff portions 24, 26, 28 overlap to yield a split cuff, as generally indicated by reference number 29, which provides added protection to a wearer's wrist and forearm because of the double layer of padding and because the cuff portions 24, 26, 28 can move with respect to one another they provide increased flexibility for a wearer's wrist as it moves during play. For example, the overlapping configurations of the cuff portions 24, 26, 28 allow them to move as a wearer's hand flexes and not open any undesirable gaps that would expose a wearer to injury. As will also be understood by one of ordinary skill in the art, a split cuff portion without overlapping portions or edges, but instead are simply aligned edge to edge, may also be employed. Further, the cuff portion 16 can be formed of a single structure or multiple structures secured together.

As shown in one embodiment, the first cuff portion 24 and the third cuff portion 28 do not extend entirely around the wearer's wrist and are connected by a lace 31 that passes through openings 34 in each of the cuff portions. Alternatively, the cuff portion 16 can consist of either a single or multiple pieces that extend entirely around a wearer's wrist, as will be readily understood by one of ordinary skill in the art. Other securing mechanism beside a lace may also be employed.

The floating subcuff portion 33 is substantially contained within the cuff portion 16 and is either flexibly attached to the cuff portion 16 or glove 10 using a plurality of elastic straps (not shown). The floating subcuff portion 33 remains closely coupled to the wrist and forearm regardless of how the wrist is flexed, therein providing additional protection to a wearer during use. A preferred subcuff portion 33 utilized in the present invention is described in U.S. patent application Ser. No. 10/904,445, and entitled "Protective Sports Glove with Floating Cuff Portion", which claims priority from U.S. Provisional Patent Application No. 60/518,772 filed Nov. 10, 2003, the disclosure of which are herein incorporated by reference.

Additionally, a wrist guard 36 is preferably coupled to the glove 10 such that it covers the space 38 between the bottom edge 40 of the hand portion 18 and the upper edge 42 of the cuff portion 16 as a wearer's hand moves and flexes during play to provide increased protection. The wrist guard 36 can be attached to the hand portion 18 or the cuff portion 16 or both and can be secured thereto by a variety of other suitable ways. Alternatively, the wrist guard 36 may be disposed within the interior space of the glove 10 to cover the space 38 from below the back side portion 12.

The hand portion 18 extends generally between the space or gap 38 and the finger portions 20 and has a rear portion 44 and a palm portion 46. The rear portion 44 preferably has a plurality of protective portions 50, such as padded portions, secured thereto to provide protection to a wearer's hand. However, protective portions constructed of other suitable material, such as plastic or rubber, may also be utilized. Each pair of protective portions 50 defines a flex line, break line or seam 52 there between, which allow the glove 10 to move as a wearer's hand moves to provide better fit and comfort. The number of padded portions 50, and hence the number of flex lines 52, may vary as desired to provide different flexing and protection characteristics and is not limited to the arrangement displayed herein.

The rear portion 44 of the hand portion 18 may also include one or more vent openings 76 to provide ventilation to a wearer's hand. The vent openings 76 can be formed along flex or break lines 52, or be contained entirely within a respective protective portion 50. It should be understood that the number of vent openings 76, as well as the location of the vent openings along flex or break lines 52 or within protective portions 50, may vary in a wide variety of ways not displayed on the accompanying figures.

The thumb portion 22 has a plurality of protective portions 102 formed thereon that extend to its tip portion 100. A flex line 104 is defined between each respective pair of the protective portions 102 to provide flexibility to the thumb.

Each of the finger portions 20 includes a plurality of protective portions 94, 96, 98 that are sewn to an outer material 99 or liner. Each of the plurality of protective portions 94, 96, 98 on one or more of the finger portions 20 is separated by a gap 97, space or break in the protective portions. In accordance with a preferred embodiment, a protective finger knuckle system 30, as will be described in further detail below in connection with FIGS. 4A-C and 5-6, is disposed in each gap 97. It will be understood that more, or less, protective portions may be included utilized on each finger portion 20 as desired.

Figure 4A:
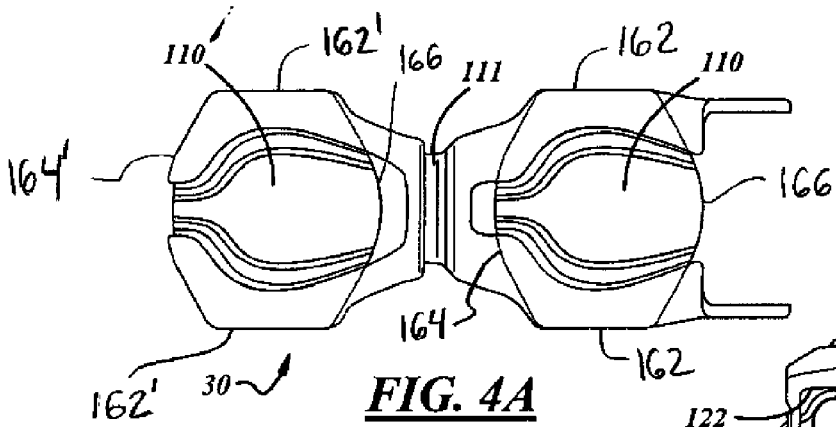
FIG. 4A is a top view of a protective knuckle system in accordance with a preferred embodiment of the present invention.
Figure 4B:
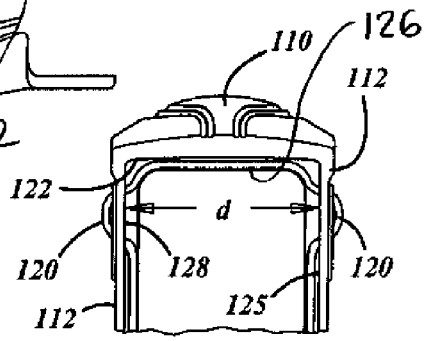
FIG. 4B is a front side view of the protective knuckle system and securing strap of FIG. 4A.
Figure 4C:
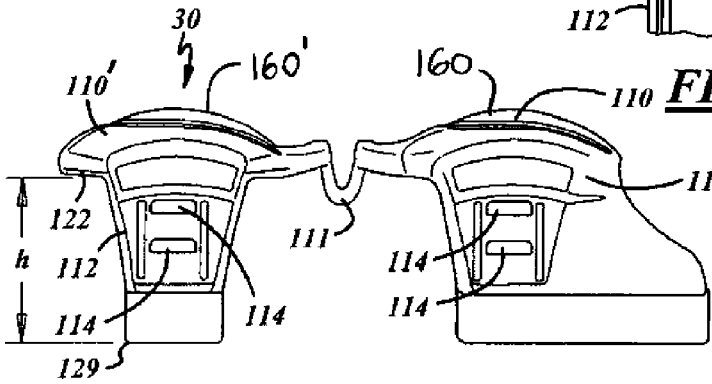
FIG. 4C is a left side view of the protective knuckle system of FIG. 4A.

Referring now to FIGS. 4A-4C, one preferred embodiment of the finger knuckle protective portion 30 is illustrated. The finger knuckle protective portion 30 is disposed on the outside or back portion of the glove 10 in the finger portions to cover the gaps 97 between of the pads corresponding to the knuckles of the fingers. The protective finger knuckle protective portion 30 includes a pair of cap portions 110, 110' coupled together via a flexible middle portion 111. One cap portion 110 is coupled to the protective portion 94 and the other cap portion 110' is coupled to the protective portion 96. The middle portion 111 extends between and connects the cap portions 110 and 110'. Due to the flexible nature of the middle portion 111, it can bend or flex to accommodate wearer movement. It will also be understood that more cap portions and middle portions may be utilized to cover more seams and protect more knuckles.

The middle portion 111 covers or overlies the die cut regions, or gaps 97, corresponding to the knuckles of the fingers. Each of the cap portions 110, 110' includes a pair of side flanges 112 that extend generally downwardly and perpendicularly from the cap portion 110, 110'. Each cap portion 110, 110' is generally dome-shaped such that it has an apex 160. The cap portions 110, 110' as shown, includes a pair of side portions 162, 162', a rounded front 164, 164', and a rounded back 166, 166'. The caps 110, 110' are preferably constructed of an impact-resistant material, such as plastic, rubber, or metal that provides protection to a wearer's finger knuckle. Other suitable materials may also be utilized. Due to the dome-shaped configuration, the thickness of the cap portions 110, 110' can vary such that their thickest part is at the apex 160, which is the area that provides greater impact resistance. Further, the dome-shape assists in dispensing the force of the blow impacted thereto. It will be understood that the cap portion 110, 110' can have a variety of different shapes and configurations.

Each of the side flanges 112 extends downwardly toward the glove liner and includes a pair of slots 114 formed on each side. One of the slots is an upper slot and one is a lower slot. More or less slots, or slots having varying configurations may also be employed. Each of the upper slot and the lower slot receives an elastic strap threaded or passed therethrough to secure the knuckle finger protection system 30 to the glove 10. Each end of the strap 120 is secured to the finger portion 20 such that the strap passes through both slots on one side, spans the space between the side flanges 112, and engages the slots on the other side flange 112.

The flexible middle portion 111 spans the gaps 97, corresponding to the die cuts or seams, between the adjacent protective portions 94, 96 or 96, 98 of the fingers and the thumb. The middle portion 111 allows flexing of the knuckles, but maintains the cap portions 110, 110' in a position to provide protection to the knuckles of the wearer when the fingers or thumb are flexed. Because the protective knuckle portion 30 is not coupled to the pads 94, 96 or 96, 98 defining the gap 97, the middle portion 111 is maintained in position over the widening gap 97 as the finger is flexed. The knuckle protection system 30 thus allow the finger to flex and unflex freely without restriction and without compromising protection. The knuckle protection system can obviously be configured to cover multiple knuckles on a single finger portion by including three cap portions and two middle portions. A protective finger knuckle portion 30, is preferably disposed on each of the finger portions 20 to protect at least one of the gaps 97 between adjacent protective portions 94, 96, 98. It will be understood that a protective finger knuckle portion can be utilized on each finger as desired.

Figure 5:
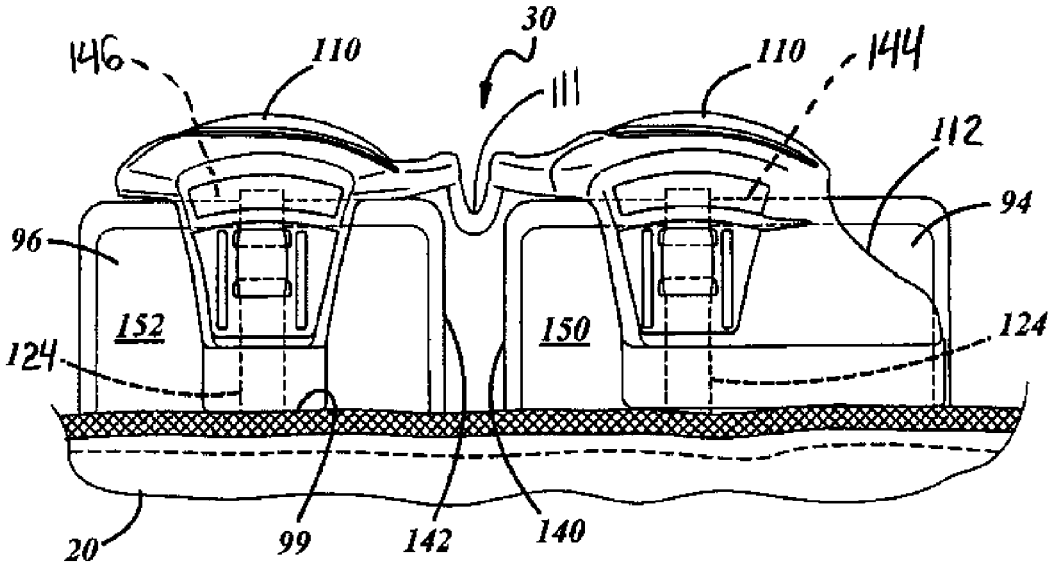
FIG. 5 is a schematic side view of the finger portion and the protective knuckle system of FIG. 1 in a flexed position in accordance with a preferred embodiment of the present invention.
Figure 6:
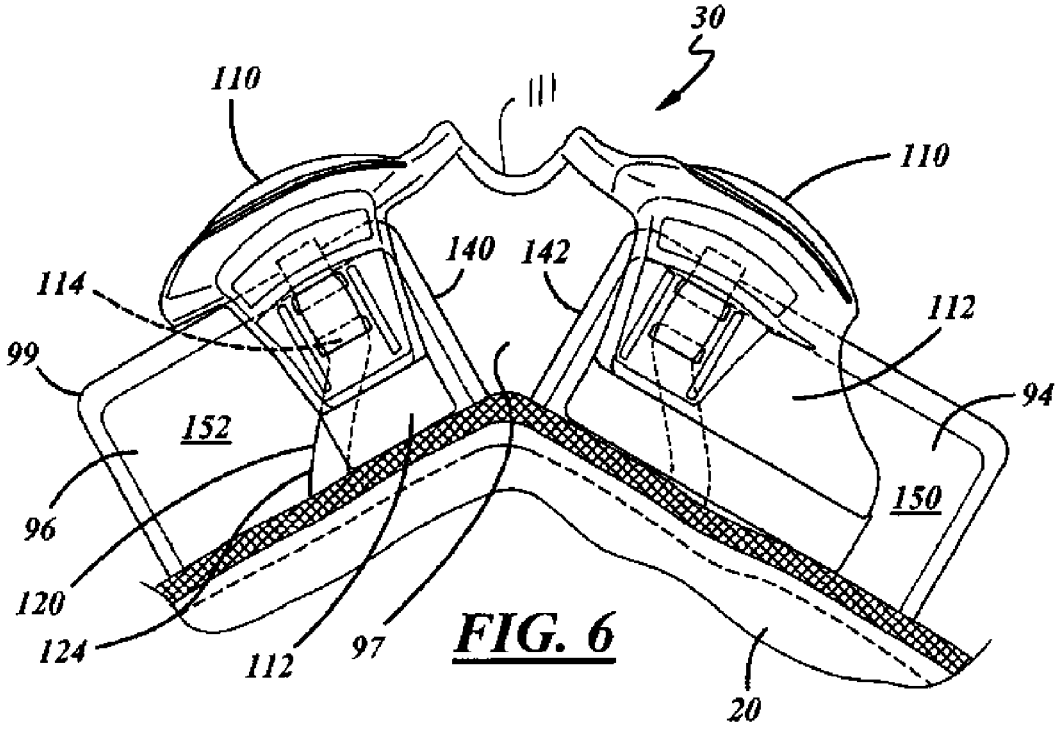
FIG. 6 is a schematic view of a protective glove with a protective knuckle system of FIG. 5 in an unflexed position in accordance with a preferred embodiment of the present invention.

As best shown in FIGS. 5 and 6, each end 124 of the strap 120 is secured to the cover material 99 of the finger portion 20 of the glove 10 by sewing, gluing or some other securing method well known to those of ordinary skill in the art. Preferably, as shown in FIGS. 5 and 6, the ends 124 of the strap 120 are sewn to the cover material 99 or liner along a side portion or within the gaps 97 between the respective padded portions 94, 96 or 96, 98. The strap can consist of a variety of other suitable materials. Further, the strap can be formed of multiple pieces.

As shown, the middle portion 111 of the finger knuckle protective portion 30 is preferably sized in a side-to-side direction to cover the entire gap 97. Further, the cap portions 110, 110' are sized to span the width of the finger portion 20. Specifically, the side flanges 112 have inside portions 128 that are spaced apart a distance (d) that is slightly greater than the width of the corresponding protective portions 94, 96, 98 of the finger portions 20, such that the cap portions 110, 110' substantially overlie the respective protective portion. Thus, the inside portions 128 are disposed outwardly from the outside surface of the protective portions and preferably contact the outer side thereof. Additionally, the height (h) of the side flanges 112 from its base 129 to the underside 122 of the cap portion 110, 110' is positioned such that it is slightly greater than and is configured such that the underside 122 of the cap portion 110, 110' is slightly above the upper surface of the protective portions 94, 96, 98.

Referring now to FIGS. 5 and 6, which illustrate one finger portion 20 utilizing the protective finger knuckle system 30 in a flexed and unflexed position. In the flexed position, as shown in FIG. 6, the straps 120 are taut enough to maintain the middle region 111 between cap portions 110, 110' in a position directly over the widening gap 97 between the end portions 140, 142 of the adjacent protective portions (shown here as protective portions 94, 96, but could also define the gap 97 between protective portions 96, 98 or any other gap). Thus any impacting blow from a stick or the like towards the widening gap 97 will contact the cap portion 110 on either side of the middle portion 111, and not the exposed gap 97 between the respective padded portions 94, 96 or 96, 98, therein providing additional protection to the underlying finger knuckle positioned within the finger portion 20 of the glove 10.

In the unflexed position, as shown in FIG. 5, the finger is generally straight. The term straight also recognizes that most protective sports gloves have some curvature to the fingers in an unflexed position, see, e.g., FIG. 3. In this position, the end portions 140, 142 are generally aligned and in close proximity to one another, therein minimizing the gap 97 there between. The finger knuckle protective portion 30 is positioned such that the underside 122 of the cap portions 110, 110' and the middle portion 126 of the strap 120 between the ends 124 and beneath the underside 122 are positioned above the top portions 144, 146 of the padded portions 94, 96 and the middle portion 111 is positioned directly over the gap 97. In addition, the inside portion 128 of the side flanges 112 is positioned outside of the respective side portions 150, 152 of the padded portions 94, 96 in the unflexed position.

While the present invention is directed to a finger knuckle protective system, a similar knuckle protective system could also be fashioned for use on a protective sports glove to protect a wearer's thumb knuckles. Moreover, while the protective sports glove is primarily used in the games of hockey and lacrosse, a protective glove having the finger knuckle protective system of the present invention could be utilized in other sports in which impacting blows to the hand may occur. In addition, the finger knuckle protective system could be utilized on non-sports related protective gloves.

While particular embodiments of the invention have been shown and described, numerous variations or alternate embodiments will occur to those skilled in the art. Accordingly, it is intended that the invention be limited only in terms of the appended claims.

What is claimed is:

1. A protective sports glove, comprising:

a hand portion comprising an inner palm portion and an opposing backside portion;

a thumb portion secured to and extending from said hand portion for receipt of a wearer's thumb therein, said thumb portion including a thumb palm portion and an opposing padded thumb portion; and a plurality of finger portions secured to and extending from said hand portion for receipt of a wearer's fingers therein, each of said plurality of finger portions including a finger palm portion and an opposing padded finger portion;

a protective knuckle feature coupled to at least one of said finger portions and positioned above a gap defined between first and second protective portions on said padded finger portion, said protective knuckle feature comprising at least two caps separated by a distance but coupled together with a middle portion, the middle portion allowing a wearer to manipulate their fingers in the protective sports glove into flexed and unflexed positions, the middle portion covering at least a portion of the gap in the flexed and unflexed positions to protect the wearer's fingers from blows directed toward the gap.

2. The protective sports glove of claim 1, wherein said caps include at least two side flanges extending toward said padded finger portion, wherein said side flanges are joined with said finger portion to retain said protective knuckle feature to said finger portion.

3. The protective sports glove of claim 2, comprising a strap joined with the protective knuckle feature, said strap adapted to stretch to allow said caps and said side flanges to move with respect to said first and second protective portions.

4. The protective sports glove of claim 3, wherein one of said caps is adapted to at least partially cover said first protective portion, wherein the other of said caps is adapted to at least partially cover said second protective portion.

5. The protective sports glove of claim 1, wherein said middle portion is positioned generally in the center of said gap in said flexed and unflexed positions.

6. The protective sports glove of claim 5, wherein said middle portion is a flexible, live hinge.

7. The protective sports glove of claim 1, wherein said middle portion hingedly joins said at least two caps.

8. The protective sports glove of claim 1, wherein said first cap overlaps said first protective portion and said second cap overlaps said second protective portion.

9. The protective sports glove of claim 1, wherein said caps are generally dome shaped and have an apex.

10. The protective sports glove of claim 9, wherein the caps are thicker at the apex than the remaining portions of said caps.

11. The protective sports glove of claim 1, wherein said caps are formed from an impact resistant material.

12. The protective sports glove of claim 11, wherein said caps are formed from at least one of plastic, rubber and metal.

13. The protective sports glove of claim 3, wherein said cap closest to said hand portion of said glove includes at least one side flange that extends to said hand portion.

14. A protective sports glove, comprising:

a hand portion comprising an inner palm portion and an opposing backside portion;

a digit portion joined with said hand portion for receipt of a wearer's digit therein, the digit portion including a digit palm portion and an opposing padded digit portion; and a protective knuckle feature joined with said digit portion and positioned above a gap defined between protective portions on said padded digit portion, said protective knuckle feature including a first cap and a second cap distal from said first cap, said first cap joined with said second cap via a flexible middle portion;

wherein said first and second caps are movable with respect to said digit portion and said protective portions when a wearer manipulates the wearer's digit between flexed and unflexed positions, wherein said middle portion covers at least a portion of said gap when the wearer's digit is in said flexed position to protect said wearer's digit from a blow imparted to the wearer's digit over the gap.

15. The protective sports glove of claim 14, wherein each of said first and second caps includes a pair of side flanges extending toward said digit portion on opposite sides of said cap.

16. The protective sports glove of claim 15, wherein said side flanges include at least one slot adapted to receive a strap that is secured to said digit portion to retain said protective knuckle feature to said protective sports glove.

17. The protective sports glove of claim 16, wherein said strap is adapted to stretch to allow said caps and said side flanges to move with respect to said protective portions.

18. The protective sports glove of claim 17, wherein said protective portions can slide with respect to said caps when the wearer manipulates said glove between flexed and unflexed positions.

19. The protective sports glove of claim 18, wherein said flexible middle portion bends in said unflexed position and extends in said flexed position.

20. The protective sports glove of claim 19, wherein said middle portion is positioned generally in the center of said gap in said flexed and unflexed positions.

* * * * *